US008820326B2

(12) United States Patent
Flannigan et al.

(10) Patent No.: US 8,820,326 B2
(45) Date of Patent: Sep. 2, 2014

(54) RESPIRATOR FACEPIECE WITH THERMOSET ELASTOMERIC FACE SEAL

(75) Inventors: Paul J. Flannigan, Roseville, MN (US); Johannes Hoogenraad, Plymouth, MN (US); David P. Knivsland, North St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 721 days.

(21) Appl. No.: 12/670,528

(22) PCT Filed: Jul. 23, 2008

(86) PCT No.: PCT/US2008/070803

§ 371 (c)(1), (2), (4) Date: Jan. 25, 2010

(87) PCT Pub. No.: WO2009/029363

PCT Pub. Date: Mar. 5, 2009

(65) Prior Publication Data

US 2010/0206311 A1 Aug. 19, 2010

Related U.S. Application Data

(60) Provisional application No. 60/999,741, filed on Aug. 31, 2007.

(51) Int. Cl.

| | |
|---|---|
| ***A62B 18/08*** | (2006.01) |
| ***A62B 19/00*** | (2006.01) |
| ***A62B 18/02*** | (2006.01) |

(52) U.S. Cl.

CPC ..... *A62B 18/025* (2013.01)

USPC ..... 128/206.15; 128/206.12; 128/206.17

(58) Field of Classification Search

USPC ..... 128/205.25, 206.12–206.19, 128/206.21–206.29, 207.11–207.13

See application file for complete search history.

(56) References Cited

U.S. PATENT DOCUMENTS

| | | | |
|---|---|---|---|
| 4,414,973 | A | 11/1983 | Matheson et al. |
| 4,790,306 | A | 12/1988 | Braun |
| 4,886,058 | A | 12/1989 | Brostrom et al. |
| 4,910,806 | A | 3/1990 | Baker |
| 5,062,421 | A | 11/1991 | Burns |
| 5,095,936 | A | 3/1992 | Briet et al. |
| 5,325,892 | A | 7/1994 | Japuntich et al. |

(Continued)

FOREIGN PATENT DOCUMENTS

| | | |
|---|---|---|
| EP | 0 613 699 | 9/1994 |
| GB | 1360632 | 7/1974 |

(Continued)

OTHER PUBLICATIONS

ShinEtsu Silicone LIMS Selective Self-Adhesive Liquid Silicon Product Brochure, 2001.

(Continued)

*Primary Examiner* — Nathan R Price

(74) *Attorney, Agent, or Firm* — Craig A. Deutsch

(57) ABSTRACT

A respiratory protection composite facepiece includes a polymeric rigid facepiece body having a first surface and a second surface, and a silicone sealing facepiece element chemically bonded to at least one of the first surface and the second surface. Methods of forming a respiratory protection composite facepiece are also disclosed.

15 Claims, 5 Drawing Sheets

(56) References Cited

U.S. PATENT DOCUMENTS

| | | | | |
|---|---|---|---|---|
| 5,366,806 | A | 11/1994 | Fujiki | |
| 5,456,027 | A * | 10/1995 | Tecchio et al. | 36/134 |
| 5,592,937 | A | 1/1997 | Freund | |
| 5,705,275 | A | 1/1998 | Nakano | |
| 5,720,280 | A | 2/1998 | Elstran et al. | |
| 6,016,804 | A | 1/2000 | Gleason et al. | |
| 6,176,239 | B1 | 1/2001 | Grove et al. | |
| 6,216,693 | B1 * | 4/2001 | Rekow et al. | 128/205.27 |
| 6,298,849 | B1 | 10/2001 | Scholey | |
| 6,843,248 | B2 | 1/2005 | Japuntich et al. | |
| 6,854,463 | B2 | 2/2005 | Japuntich et al. | |
| 7,117,868 | B1 | 10/2006 | Japuntich et al. | |
| 8,136,524 | B2 | 3/2012 | Ging | |
| 2001/0013347 | A1 | 8/2001 | Rekow | |
| 2001/0035188 | A1 | 11/2001 | Gleason et al. | |
| 2002/0020416 | A1 | 2/2002 | Namey | |
| 2002/0094414 | A1 | 7/2002 | Wagenblast | |
| 2002/0170563 | A1 | 11/2002 | Japuntich et al. | |
| 2002/0185133 | A1 | 12/2002 | Japuntich et al. | |
| 2002/0195109 | A1 | 12/2002 | Mittelstadt | |
| 2003/0084902 | A1 | 5/2003 | Japuntich et al. | |
| 2003/0153934 | A1 * | 8/2003 | Gerberding | 606/157 |
| 2004/0025880 | A1 | 2/2004 | Capon et al. | |
| 2004/0149287 | A1 | 8/2004 | Namey, Jr. | |
| 2005/0109343 | A1 | 5/2005 | Flanningan et al. | |
| 2006/0117469 | A1 | 6/2006 | Garofalo et al. | |
| 2007/0119459 | A1 | 5/2007 | Japuntich et al. | |
| 2008/0133001 | A1 * | 6/2008 | Shalev et al. | 623/1.49 |
| 2009/0032024 | A1 | 2/2009 | Burz et al. | |

FOREIGN PATENT DOCUMENTS

| | | |
|---|---|---|
| JP | 60-143917 | 7/1985 |
| JP | S60-143917 | 7/1985 |
| JP | 63-180058 | 11/1988 |
| JP | 2000-167075 | 6/2000 |
| JP | 2003-330296 | 11/2003 |
| JP | 2006 289093 | 10/2006 |
| WO | WO 93/24181 | 12/1993 |
| WO | 95/09676 | 4/1995 |
| WO | 96/34658 | 11/1996 |
| WO | 96/40370 | 12/1996 |
| WO | WO 96/40370 | 12/1996 |
| WO | WO 02/13884 | 2/2002 |
| WO | WO 2004/052439 | 6/2004 |
| WO | WO 2005/051490 | 6/2005 |
| WO | WO 2007/009182 | 1/2007 |

OTHER PUBLICATIONS

ShinEtsu LIMS Product Selection Guide, 2007.

Wacker Silicones Elastosil® LR3070 A, B Product Brochure, 2007.

Shin-Etsu, The Industry's First Polyamide Resin Selective Adhesion Performance, Shin-Etsu Chemical Developed a Breakthrough Liquid Silicone Rubber (LIMS). (Shin-Etsu chemical homepage 2001 news) (www.silicone.jp/j/news/2001/03.shtml).

* cited by examiner

RESPIRATOR FACEPIECE WITH THERMOSET ELASTOMERIC FACE SEAL

CROSS REFERENCE TO RELATED APPLICATIONS

This application is a national stage filing under 35 U.S.C. §371 of PCT/US2008/070803, filed Jul. 23, 2008, which claims priority to U.S. Application No. 60/999,741, filed Aug. 31, 2007, the disclosure of which is incorporated by reference in its/their entirety herein.

FIELD

The present disclosure relates to a respiratory protection composite facepiece and particularly to a respirator facepiece with a thermoset elastomeric face seal.

BACKGROUND

Half-mask respirators provide respiratory protection from airborne substances with filtering processes and/or otherwise facilitating access to clean air. One characteristic of these devices is the seal that is formed between the user and other functional components of the respiratory protection device. Respirators often utilize an elastomeric material to form the seal which is often referred to as the "faceseal."

One design consideration with these respirators is the air-tight fastening of the elastomeric faceseal with the solid structural components of the respirator. This air-tight seal often requires a mechanical seal that adds complexity and cost to the respirator design.

BRIEF SUMMARY

The present disclosure relates to a respiratory protection composite facepiece and particularly to a respirator facepiece with a thermoset elastomeric face seal. This disclosure further relates to a respirator facepiece having a polymeric rigid facepiece body portion and a silicone sealing facepiece element that is chemically bonded to at least one surface of the polymeric rigid facepiece body portion. In many embodiments, the silicone sealing facepiece element is chemically bonded to at least two surfaces of the polymeric rigid facepiece body portion. In some embodiments, the silicone sealing facepiece element also penetrates through at least one aperture of the polymeric rigid facepiece body portion.

In a first embodiment, a respiratory protection composite facepiece includes a polymeric rigid facepiece body portion having a first surface and a second surface, and a silicone sealing facepiece element chemically bonded to at least one of the first surface and the second surface. The first and second surfaces can be opposing major surfaces. In some embodiments, the silicone sealing facepiece element may be chemically bonded to at least two opposing major surfaces of the polymeric rigid facepiece body portion. The silicone sealing facepiece element may in some cases also interpenetrate apertures that extend through the polymeric rigid facepiece body portion.

In another embodiment, a method of forming a respiratory protection composite facepiece includes overmolding liquid silicone onto a polymeric rigid facepiece body portion having a first surface and a second surface. The liquid silicone is in contact with at least one of the first surface or the second surface. The method further includes solidifying the liquid silicone to form a silicone sealing facepiece element that chemically bonds to the at least one of the first surface or second surface to form a respiratory protection composite facepiece element.

BRIEF DESCRIPTION OF THE DRAWINGS

The invention may be more completely understood in consideration of the following detailed description of various embodiments of the invention in connection with the accompanying drawings, in which.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Figure 1:
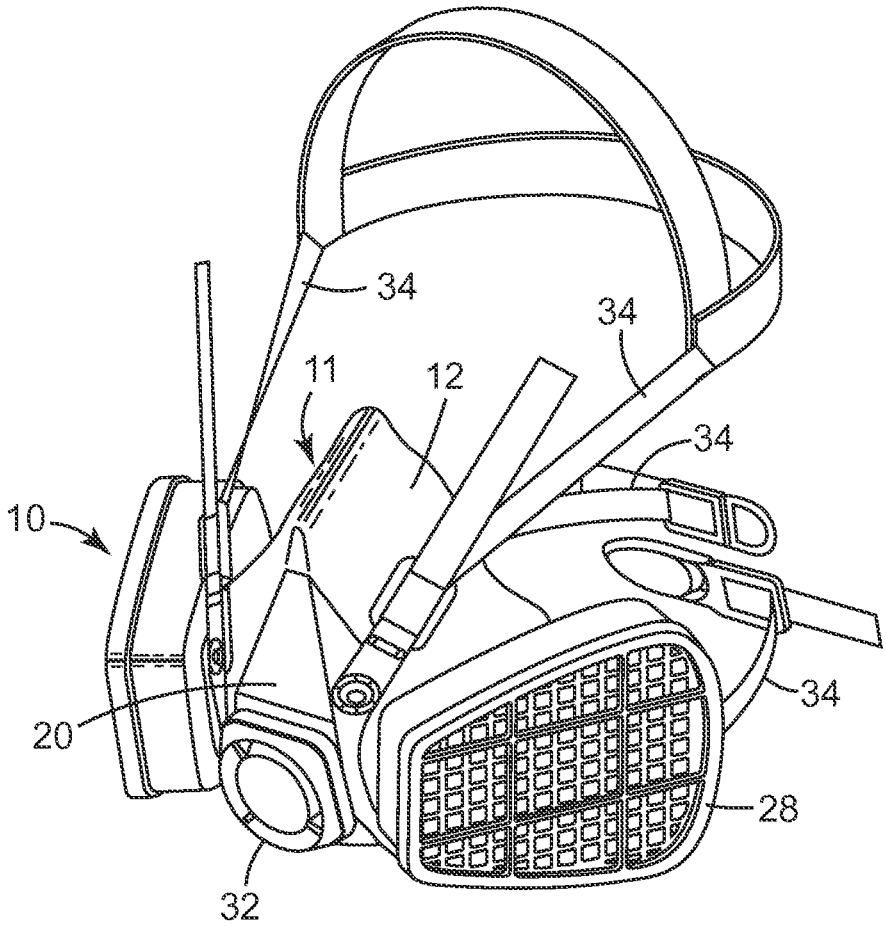
FIG. 1 is a perspective view of an illustrative respiratory protection mask.

In the following description, reference is made to the accompanying drawings that form a part hereof, and in which are shown by way of illustration several specific embodiments. It is to be understood that other embodiments are contemplated and may be made without departing from the scope or spirit of the present invention. The following detailed description, therefore, is not to be taken in a limiting sense.

All scientific and technical terms used herein have meanings commonly used in the art unless otherwise specified. The definitions provided herein are to facilitate understanding of certain terms used frequently herein and are not meant to limit the scope of the present disclosure.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

The recitation of numerical ranges by endpoints includes all numbers subsumed within that range (e.g. 1 to 5 includes 1, 1.5, 2, 2.75, 3, 3.80, 4, and 5) and any range within that range.

As used in this specification and the appended claims, the singular forms "a", "an", and "the" encompass embodiments having plural referents, unless the content clearly dictates otherwise. As used in this specification and the appended claims, the term "or" is generally employed in its sense including "and/or" unless the content clearly dictates otherwise.

The term "respirator" means a personal respiratory protection device that is worn by a person to filter air before the air enters the person's respiratory system. This term includes full face respirators, half mask respirators, powered air purifying respirators, and self contained breathing apparatus.

The present disclosure relates to a respiratory protection composite facepiece and particularly to a respirator facepiece with a thermoset elastomeric face seal. This disclosure further relates to a respirator facepiece having a polymeric rigid facepiece body portion and a silicone sealing facepiece element that is chemically bonded to at least one surface of the polymeric rigid facepiece body portion. In many embodiments, the silicone sealing facepiece element that is chemically bonded to at least two surface of the polymeric rigid facepiece body portion. In some embodiments, the silicone sealing facepiece element also penetrates through the polymeric rigid facepiece body portion. This respirator facepiece can be formed by molding a thermoset silicone sealing facepiece element onto the polymeric thermoplastic rigid facepiece body portion. These respirator facepieces have a robust bond between the silicone sealing facepiece element and the rigid facepiece body portion. While the present invention is not so limited, an appreciation of various aspects of the invention will be gained through a discussion of the examples provided below.

The respirator facepiece having an overmolded thermoset elastomeric seal provides a face sealing element that is integrally bonded with the polymeric rigid facepiece body portion. This construction has been found to enhance the durability of the seal and prevent debris from being interposed between the polymeric rigid facepiece body portion and the thermoset elastomeric seal. This integral construction also reduces the number of assembly parts and part size variability. The overmolded thermoset elastomeric seal materials described herein also do not require that the polymeric rigid facepiece body portion be primed in order for the thermoset elastomeric seal to be chemically attached to the polymeric rigid facepiece body portion.

FIG. 1 is a perspective view of an illustrative respiratory protection mask 10. The respiratory protection mask 10 includes a respiratory protection composite facepiece 11 attached to number of respiratory protection elements including, for example, one or more inhalation valves with a chemical or particulate filtration cartridge 28 connected to one or more of the inhalation valves, one or more exhalation valves 32, one or more speaking diaphragms and/or one or more straps 34 configured to secure the respiratory protection composite facepiece 11 to a user's head.

The respiratory protection composite facepiece 11 includes a silicone sealing facepiece element 12 overmolded onto a polymeric rigid facepiece body 20 (as described in more detail below). The chemical or particulate filtration cartridge 28 to can be either fixedly attached or removably attached to the one or more of the inhalation diaphragm valves. In some embodiments, the silicone sealing facepiece element 12 also forms a seal or gasket between the chemical or particulate filtration cartridge 28 and the polymeric rigid facepiece body 20 or inhalation valve (as described in more detail below). The chemical or particulate filtration cartridge 28 can have any useful shape, other than the shape illustrated in FIG. 1.

While FIG. 1 illustrates a respiratory protection mask 10 having two cheek inhalation valves attached to a chemical or particulate filtration cartridge 28 and one nose exhalation valve 32, any useful respiratory protection configuration is possible. For example, the respiratory protection mask 10 can have a single inhalation valve attached to a chemical or particulate filtration cartridge 28 or clean air supply and one or two exhalation valves or one or more speaking diaphragms, as desired.

Figure 5:
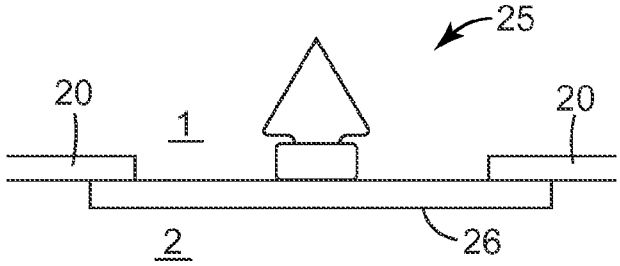
FIG. 5 and FIG. 6 are schematic cross-section views of an illustrative inhalation or exhalation diaphragm valve.
Figure 6:
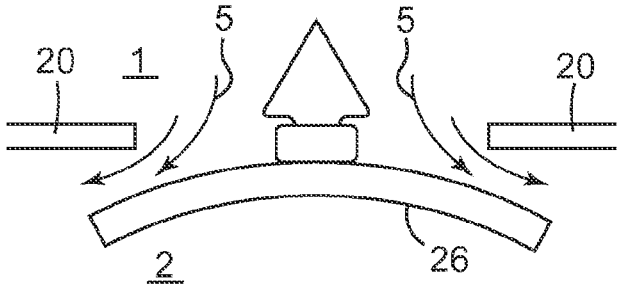
Figure 7:
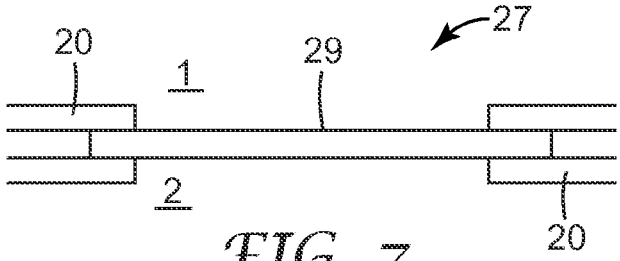
FIG. 7 is a schematic cross-section view of an illustrative speaking diaphragm.

FIG. 5 and FIG. 6 are schematic cross-section views of an illustrative inhalation or exhalation valve. FIG. 7 is a schematic cross-section view of an illustrative speaking diaphragm. These inhalation or exhalation valves or speaking diaphragm are located within or adjacent to the plurality of openings of the rigid facepiece body 20, described below.

FIG. 5 illustrates a partial schematic diagram of a diaphragm valve disposed between an exterior area 1 or 2 and an interior area 2 or 1 of the illustrative respiratory protection mask 10. The diaphragm 25 is an inhalation diaphragm when the diaphragm 26 is disposed between the rigid facepiece body 20 and the user's face or the interior area 2 of the illustrative respiratory protection mask 10. The diaphragm 25 is an exhalation diaphragm when the diaphragm 26 is disposed between the rigid facepiece body 20 and the exterior area 1 of the illustrative respiratory protection mask 10. FIG. 6 illustrates the diaphragm valve allowing either inhalation air 5 or exhalation air 5 to pass between the diaphragm 26 and the valve body or rigid facepiece body 20.

FIG. 7 illustrates a partial schematic diagram of a speaking diaphragm 27. The illustrative speaking diaphragm 27 includes a diaphragm 29 fixed to the rigid facepiece body 20 or the speaking diaphragm body portion. The speaking diaphragm 29 is disposed between the exterior area 1 or 2 and an interior area 2 or 1 of the illustrative respiratory protection mask 10. The speaking diaphragm 27 assists in the transmission of speech from the respiratory protection mask 10 user.

Figure 2:
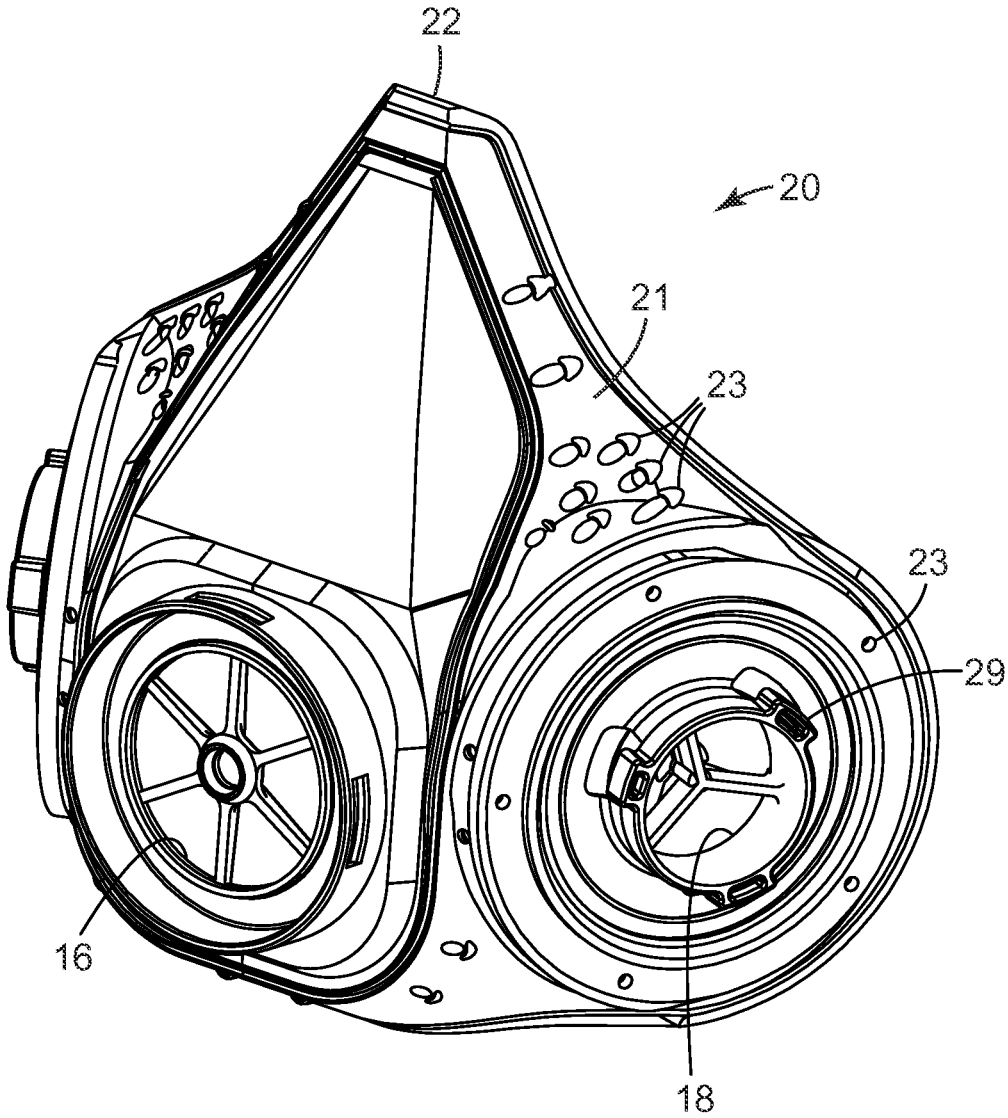
FIG. 2 is a perspective view of an illustrative rigid facepiece body for a respirator protection mask.

FIG. 2 is a perspective view of an illustrative rigid facepiece body 20 for a respirator protection mask 10. The rigid facepiece body 20 includes a first surface 21 and a second surface 22. In the illustrated embodiment, the first surface 21 and a second surface 22 are opposing major surfaces of the rigid facepiece body 20, separated by a body thickness T (see FIG. 4). In the illustrated embodiment, the first surface 21 is an outer surface (directed toward the environment) and the second surface 22 is an inner surface (directed toward a user's face). The illustrated rigid facepiece body 20 includes a plurality of openings or ports such as, for example, a nose opening 16 and two cheek openings 18. At least one inhalation valve including a diaphragm (not shown) and one exhalation valve including a diaphragm (not shown) are disposed within the plurality of ports or openings and forms the illustrated rigid facepiece body 20. In some embodiments, a speaking diaphragm is disposed within one or more of the plurality of ports or openings and forms the illustrated rigid facepiece body 20.

In many embodiments, one or more apertures 23 extend through the body thickness T. During the overmolding manufacture of the respiratory protection composite facepiece 11 liquid silicone (that forms the silicone sealing facepiece element 12) flows through the one or more apertures 23 and forms a mechanical interlock between the silicone sealing facepiece element 12 and the rigid facepiece body 20. In some embodiments, the inhalation valve includes a chemical or particulate filtration cartridge attachment element 29. In many embodiments, the attachment element 29 is a bayonet attachment element that mates with a complementary element on the chemical or particulate filtration cartridge attachment element 29. A bayonet attachment system is configured for attaching two portions together, where the two portions include elements other than mainly threads such that the two portions are attached by inserting one portion at least partially within the other portion and rotating one portion relative to the other portion so that the two portions can be joined without multiple turns.

Figure 3:
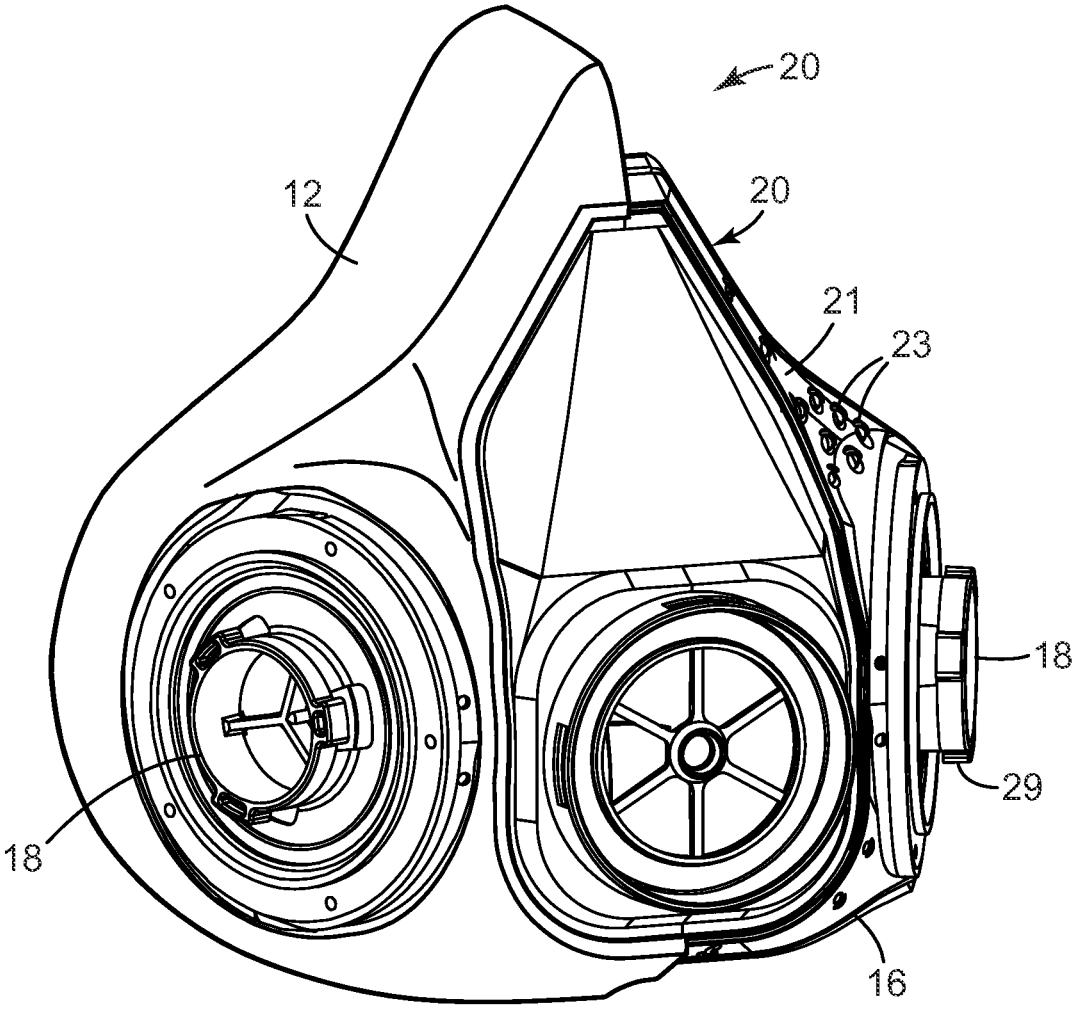
FIG. 3 is a perspective front view of the rigid facepiece body shown in FIG. 2 illustrating a silicone sealing facepiece element overmolded onto half of the rigid facepiece body.
Figure 4:
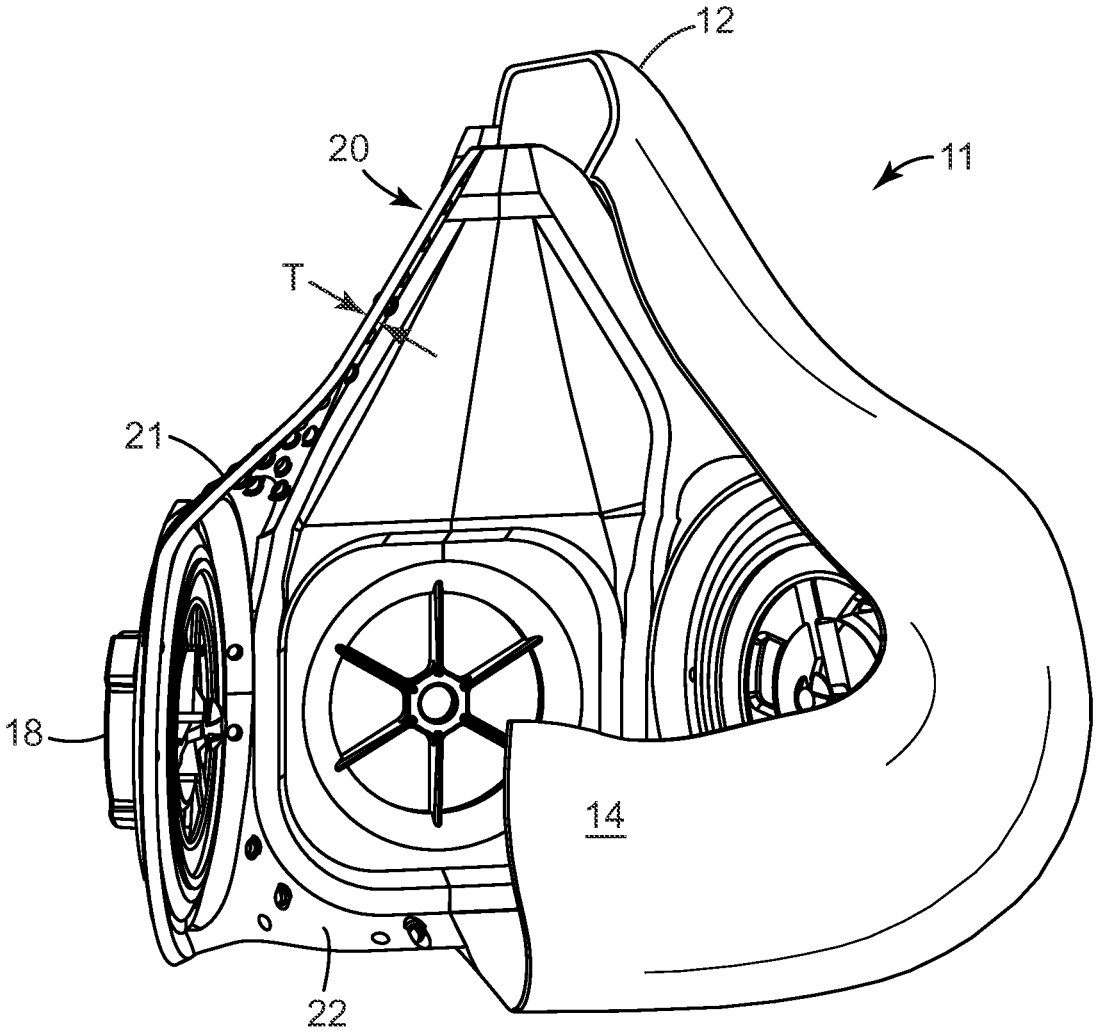
FIG. 4 is a perspective rear view of the rigid facepiece body shown in FIG. 2 illustrating a silicone sealing facepiece element overmolded onto half of the rigid facepiece body.

FIG. 3 is a perspective front view of the rigid facepiece body 20 shown in FIG. 2 with a silicone sealing facepiece element 12 overmolded onto half of the rigid facepiece body 20. FIG. 4 is a perspective rear view of the rigid facepiece body shown in FIG. 2 with a silicone sealing facepiece element overmolded onto half of the rigid facepiece body. It is understood that the exemplary respiratory protection composite facepiece 11 includes the silicone sealing facepiece element 12 overmolded onto both halves of the rigid facepiece body 20, but is shown as a cross-section of the silicone sealing facepiece element 12 to more easily illustrate the contour of the silicone sealing facepiece element 12.

The rigid facepiece body 20 is described above. The silicone sealing facepiece element 12 is chemically bonded to at least one of a first surface and a second surface of the rigid facepiece body 20, such as at least one of the first surface 21 and the second surface 22. In many embodiments, the silicone sealing facepiece element 12 is chemically bonded to at least one of the first surface 21 and the second surface 22, where the first surface 21 and a second surface 22 are major surfaces of the rigid facepiece body 20, separated by a body thickness T, as described above.

During the overmolding manufacture of the respiratory protection composite facepiece 11 liquid silicone (that forms the silicone sealing facepiece element 12) flows through the one or more apertures 23 and forms a mechanical interlock between the silicone sealing facepiece element 12 and the rigid facepiece body 20 once the liquid silicone is cured to its solid state.

Figure 8:
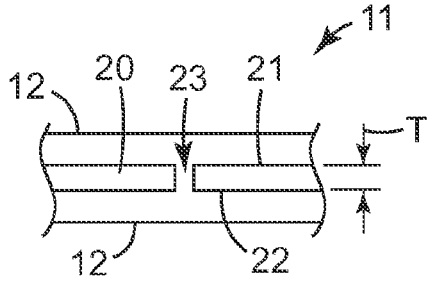
FIG. 8 illustrates a schematic cross-sectional view of portion of a respiratory protection composite facepiece illustrating a mechanical interlock created when the liquid silicone interpenetrates an aperture through the rigid facepiece body.

FIG. 8 illustrates a schematic cross-sectional view of portion of a respiratory protection composite facepiece 11 illustrating a mechanical interlock created when the liquid silicone interpenetrates an aperture 23 through the rigid facepiece body 20. The silicone sealing facepiece element 12 is disposed on and is chemically bonded to the first surface 21 and the second surface 22, where the first surface 21 and a second surface 22 are major surfaces of the rigid facepiece body 20, separated by a body thickness T, as described above.

Referring back to FIG. 3 and FIG. 4, the silicone sealing facepiece element 12 is configured to form an air-tight seal between a user's head or face and the rigid facepiece body 20. The term "air-tight seal" refers to a connection of the silicone sealing facepiece element 12 to the user's face or head that substantially prevents unfiltered or ambient air from entering an interior portion of the respiratory protection composite facepiece 11 at the connection interface. The illustrated silicone sealing facepiece element 12 includes an in-turned feathered cuff 14 that contacts a user's face.

Air-tightness is measured with a vacuum leak test. The test fixture consists of a sealed chamber with three ports. The volume of the chamber is approximately 750 $cm^3$. A respirator attachment component is affixed to one of the three ports by means of its bayonet attachment element. A vacuum gauge capable of measuring the pressure differential between the inside of the chamber and the ambient air (to at least 25 cm water) is attached to a second port on the fixture. A vacuum source is attached to the third port through a shut off valve. To conduct the test, the shut-off valve is opened and the vacuum source is turned on to evacuate the chamber to a pressure of 25 cm water below atmospheric pressure (as indicated by the vacuum gauge). The shut-off valve is then closed and the vacuum source is turned off. The vacuum level inside the chamber is monitored for 60 seconds. Inward leakage of air causes the pressure inside the chamber to increase, thereby reducing the vacuum level. For the current invention, the pressure differential between the chamber and the ambient air is greater than 15 cm of water after 60 seconds. More preferably, the pressure differential remains above 24 cm of water after 60 seconds.

The respiratory protection composite facepiece 11 can be formed by overmolding a thermosetting silicone material onto a thermoplastic rigid facepiece body 20. The thermosetting silicone material chemically bonds (i.e., adhesive bonding or covalent bonding) to the thermoplastic rigid facepiece body 20.

The terms "chemical bonding or chemically bonded" refer to physical processes responsible for the attractive interactions between atoms and molecules and includes covalent and ionic bonds, as well as hydrogen and van der Waal's bonds and can often depend on available functional groups on the rigid facepiece body 20 surface and their reactivity with the thermosetting silicone material. In many embodiments, the thermosetting silicone material is selected so that pretreatment of the thermoplastic rigid facepiece body 20 is not necessary. In other words, the thermosetting silicone material is self-adhesive with the thermoplastic rigid facepiece body 20. The thermosetting silicone material is often heated to cure the thermosetting silicone material during the overmolding process to a temperature sufficient to cure the thermosetting silicone material but less than a glass transition temperature of the thermoplastic rigid facepiece body 20.

As shown in the Examples below, the level of chemical bonding can be determined by the average force to failure test method. In many embodiments, the average force to failure is 25 N or greater, or 50 N or greater, or 100 N or greater, or 150 N or greater, or 200 N or greater, or 300 N or greater.

The thermoplastic rigid facepiece body 20 can be formed of any useful thermoplastic material. In many embodiments, the thermoplastic rigid facepiece body 20 is formed of a polyamide (e.g., nylon), a polycarbonate, polybutyleneterephthalate, polyphenyl oxide, polyphthalamide, or mixtures thereof.

Any useful thermosetting liquid silicone rubber or material can be utilized to form the silicone sealing facepiece element 12. Liquid silicone rubber is a high purity platinum cured silicone with low compression set, great stability and ability to resist extreme temperatures of heat and cold. Due to the thermosetting nature of the material, liquid silicone injection molding often requires special treatment, such as intensive distributive mixing, while maintaining the material cool before it is pushed into the heated cavity and vulcanized. Silicone rubber is a family of thermoset elastomerics that have a backbone of alternating silicone and oxygen atoms and methyl or vinyl side groups. Silicone rubbers maintain their mechanical properties over a wide range of temperatures and the presence of methyl-groups in silicone rubbers makes these materials hydrophobic.

Illustrative thermosetting silicone material includes self-adhesive liquid silicone rubbers available under the trade designation: ELASTOSIL LR 3070 from Wacker-Silicones, Munich, Germany; the KE2095 or KE2009 series (such as, for example, KE2095-60, KE2095-50, KE2095-40) or X-34-1547A/B, X-34-1625A/B, X-34-1625A/B all from Shin-Etsu Chemical Co., LTD., Japan. These self-adhesive liquid silicone rubbers do not require pretreatment of certain thermoplastic surfaces for the liquid silicone rubbers to chemically bond to the thermoplastic surface.

EXAMPLES

Several tests were used to identify suitable combinations of silicone rubbers and thermoplastic materials. Of particular interest is the strength of the bond between the silicone rubber and thermoplastic material, which affects the durability of the air-tight seal.

The test strip is prepared by molding a rigid, flat substrate piece 51 mm long, 25 mm wide, and 2 mm thick with thermoplastic material. The substrate is then clamped into a second mold such that 6 mm of one end of the substrate protrudes into the cavity of the second mold. The cavity of the second mold is 27 mm wide and 49 mm long. The depth of the mold is 2 mm, expanding to 4 mm in the immediate vicinity of the protruding substrate end, such that when silicone is injected into the mold cavity it forms a layer 1 mm thick on all sides of the protruding substrate end. The resulting test strip is thus 94 mm long, with a rigid thermoplastic substrate piece on one end and silicone rubber on the other end.

The strength of the bond between the substrate material and silicone is measured by gripping the two ends of the test strip in the jaws of a mechanical tester such as an MTS Model 858 Material Test System (MTS Systems Corporation, Eden Prairie, Minn.), stretching it until the test strip breaks apart, and recording the force at which failure occurs. Examples of the force to failure are shown in Table 1. Examples 1 through 4 show that bond strengths greater than 300 N can be achieved with the appropriate combination of materials. For Comparative Examples C1 and C2, the silicone did not bond to the thermoplastic material.

| Example | Silicone | Thermoplastic Substrate | Average Force to Failure (N) |
|---|---|---|---|
| 1 | Shin-Etsu KE2095-60 | RTP Nylon 6/6 | 136 |
| 2 | Wacker 3070-60 | RTP Nylon 6/6 | 303 |
| 3 | Dow LC-70-2004 | Zytel PA | 174 |
| 4 | Wacker 3070-60 | Zytel PA | 166 |
| C1 | Dow LC-70-2004 | RTP Nylon 6/6 | No bonding |
| C2 | Shin-Etsu KE2095-60 | Zytel PA | No bonding |

Dow LC-70-2004 silicone is produced by Dow Corning Corporation, Midland Mich.; RTP Nylon 6/6 is a polyamide produced by RTP Company, Winona, Minn.; Zytel PA is a polyamide produced by E.I. du Pont de Nemours, Wilmington, Del.

Thus, embodiments of the RESPIRATOR FACEPIECE WITH THERMOSET ELASTOMERIC FACE SEAL are disclosed. One skilled in the art will appreciate that the present invention can be practiced with embodiments other than those disclosed. The disclosed embodiments are presented for purposes of illustration and not limitation, and the present invention is limited only by the claims that follow.

What is claimed is:

1. A respiratory protection composite facepiece comprising:

a polymeric rigid facepiece body comprising a polyamide and having a first surface and a second surface; and a thermosetting liquid silicone sealing facepiece element chemically bonded to at least the first surface and the second surface, the thermosetting liquid silicone sealing facepiece element configured to form a seal between a user's face and the polymeric rigid facepiece body;

wherein the polymeric rigid facepiece body portion comprises an inhalation valve and a filtration cartridge attached to the inhalation valve, and the silicone sealing facepiece element forms a gasket between the filtration cartridge and the polymeric rigid facepiece body portion.

2. A respiratory protection composite facepiece according to claim 1, wherein the first surface and the second surface are opposing major surfaces separated by a body thickness and the silicone sealing facepiece element is chemically bonded to at least the first surface and the second surface.

3. A respiratory protection composite facepiece according to claim 1, wherein the polymeric rigid facepiece body comprises at least one aperture extending through the polymeric rigid facepiece body and the silicone sealing facepiece element interpenetrates the aperture.

4. A respiratory protection composite facepiece according to claim 1, wherein the polymeric rigid facepiece body comprises a plurality of apertures extending through the polymeric rigid facepiece body and the silicone sealing facepiece element interpenetrates the apertures.

5. A respiratory protection composite facepiece according to claim 1, wherein the silicone sealing facepiece comprises thermosetting liquid silicone rubber.

6. A respiratory protection composite facepiece according to claim 1, further comprising a speaking diaphragm fixed to the polymeric rigid facepiece body portion.

7. A respiratory protection composite facepiece according to claim 1, wherein the silicone sealing facepiece comprises thermosetting liquid silicone rubber characterized by a polymer having a backbone of alternating silicone and oxygen atoms and methyl or vinyl side groups.

8. A respiratory protection composite facepiece according to claim 1, wherein the chemical bonding is characterized by average force to failure of at least 100 N.

9. A respiratory protection composite facepiece according to claim 1, wherein the silicone sealing facepiece element is adhesively bonded to at least one of the first surface and the second surface.

10. A respiratory protection composite facepiece according to claim 9, wherein the first surface and the second surface are opposing major surfaces separated by a body thickness and the silicone sealing facepiece element is adhesively bonded to at least the first surface and the second surface.

11. A respiratory protection composite facepiece according to claim 9, wherein the silicone sealing facepiece comprises thermosetting liquid silicone rubber.

12. A respiratory protection composite facepiece according to claim 9, wherein the silicone sealing facepiece comprises thermosetting liquid silicone rubber characterized by a polymer having a backbone of alternating silicone and oxygen atoms and methyl or vinyl side groups.

13. A respiratory protection composite facepiece according to claim 9, wherein the adhesive bonding is characterized by average force to failure of at least 100 N.

14. A respiratory protection composite facepiece according to claim 9, wherein the adhesive bonding is characterized by average force to failure of at least 200 N.

15. A respiratory protection composite facepiece according to claim 9, wherein the adhesive bonding is characterized by average force to failure of at least 300 N.

* * * * *